US006381915B1

(12) United States Patent
Wood

(10) Patent No.: US 6,381,915 B1
(45) Date of Patent: May 7, 2002

(54) ARCHITECTURAL MOLDING AND MOUNTING DEVICE THEREFOR

(75) Inventor: James Wood, Williamsport, PA (US)

(73) Assignee: Selectrim Corporation, Williamsport, PA (US)

( * ) Notice: Subject to any disclaimer, the term of this patent is extended or adjusted under 35 U.S.C. 154(b) by 0 days.

(21) Appl. No.: 09/234,013

(22) Filed: Jan. 19, 1999

(51) Int. Cl.[7] ..... E04L 2/38

(52) U.S. Cl. ..... 52/718.06; 52/211; 52/288.1; 52/716.8; 52/717.03; 52/717.05; 52/718.03; 52/718.02; 52/718.05; 52/717.01; 248/617; 248/621; 248/632

(58) Field of Search ..... 52/211, 287.1, 52/288.1, 718.06, 718.03, 717.03, 717.05, 718.01, 716.8, 717.01; 403/295, 298; 248/634, 674, 326, 327, 329, 397, 619, 632, 621, 617

(56) References Cited

U.S. PATENT DOCUMENTS

| | | | | |
|---|---|---|---|---|
| 3,107,759 A | | 10/1963 | Day et al. | |
| 3,245,124 A | | 4/1966 | Faske | |
| 4,094,112 A | | 6/1978 | Smith et al. | |
| 4,104,839 A | * | 8/1978 | Balzer et al. | 52/288 |
| 4,281,481 A | | 8/1981 | Wendt | |
| 4,430,833 A | * | 2/1984 | Balzer et al. | 52/255 |
| 4,443,984 A | | 4/1984 | Rasmussen | |
| 5,096,328 A | | 3/1992 | Knapp | |
| 5,096,753 A | * | 3/1992 | McCue et al. | 428/31 |
| 5,283,096 A | * | 2/1994 | Greenberg et al. | 428/67 |
| 5,651,224 A | | 7/1997 | Brabant | |
| 5,694,726 A | * | 12/1997 | Wu | 52/287.1 |
| 5,711,123 A | * | 1/1998 | Lamont et al. | 52/287.1 |
| 5,779,380 A | | 7/1998 | Knapp | |

OTHER PUBLICATIONS

1997 Knapp product catalog, pp. 6–7.
1997 Timely product catalog, pp. 4–5.

* cited by examiner

*Primary Examiner*—Yvonne M. Horton
(74) *Attorney, Agent, or Firm*—Synnestvedt & Lechner LLP

(57) ABSTRACT

A mounting device for mounting a molding, a molding, and a mounting system including the mounting device and the molding. A method for mounting the molding using the mounting device is also provided. The mounting device is adapted for mounting to a surface and has a protective lip to retain and protect an inner edge of the molding. The mounting device also has a snap-catch for securing the molding. The molding has a decorative top surface and an underside adapted to receive the snap-catch of the mounting device and to prevent interference of the molding with fasteners used to secure the mounting device to the surface. The arrangement provides for quick, snap mounting and/or demounting the molding to the mounting device without the need for removal of fasteners.

13 Claims, 5 Drawing Sheets

ARCHITECTURAL MOLDING AND MOUNTING DEVICE THEREFOR

FIELD OF THE INVENTION

This invention relates generally to mounting devices and more particularly to devices for releasably mounting architectural moldings to a surface. This invention further relates to the mounting of architectural moldings to a hollow metal door frame of the type commonly used in commercial grade building construction.

BACKGROUND OF THE INVENTION

Past and present building construction has frequently included the adornment of walls, ceilings and other surfaces with decorative architectural moldings. This is particularly true around windows and doorways which are typically framed in wood and trimmed with wooden casing molding. With respect to a doorway, the casing is typically applied along the door jamb and header surfaces. While wooden framing and trimming is aesthetically pleasing, it is often prohibitively expensive since substantial carpentry is required.

Typical commercial grade constructions employ a hollow metal door frame which is relatively inexpensive as compared to comparable wooden framing and which has the added benefit of fire resistance. Such hollow metal door frames are typically of steel or aluminum construction and are well known in the art. A fire resistant aluminum door frame assembly is disclosed in U.S. Pat. No. 4,281,481 to Wendt. A door, window, and partition casing arrangement for dry wall partitions is shown in U.S. Pat. No. 4,443,984 to Rasmussen.

Frequently, the metal surface of such frames is left exposed with a painted finish. However, in some installations, it is desirable to trim the door frame with decorative architectural moldings. Trimming of metal door frames is contemplated in U.S. Pat. No. 3,107,759 to Day et al. which discloses a prefabricated door frame and molding structure, and in U.S. Pat. No. 4,094,112 to Smith which discloses a metal door frame and trim clip. While these patents provide for mounting of molding to trim a doorway, they contemplate mounting of rather unappealing metal or plastic trim and not more delicate moldings such as wooden molding.

Furthermore, none of these patents contemplates protection of the molding. This is particularly important with molding on doorways where carts, dolleys, wheelchairs, gurneys, or the like may travel. Such traffic can cause unsightly damage to the trim which is expensive to repair. This is particularly important in the case of wooden trim moldings which are easily damaged.

SUMMARY OF THE INVENTION

Accordingly, it is an object of the present invention to provide a mounting device for an object, such as an architectural molding, which provides protection from damage. It is another object of the present invention to provide a mounting device which is compatible with a hollow metal door frame. It is a further object of the present invention to provide a mounting device which may be quickly and easily installed in proper alignment with a frame and which in turn provides for quick and easy mounting of a molding. It is yet a further object of the present invention to provide a mounting device which allows for positive mounting of a molding and yet provides for quick and easy removal and replacement of a molding. It is yet a further object of the present invention to provide a mounting device that allows for simple adjustments at the time of installation to ensure a precise fit of moldings, despite slight departures of the dimensions of the door frame, the molding or the mounting device from a desired standard. It is yet a further object of the present invention to provide a mounting device which imparts a degree of fire resistance to a doorway around which the mounting device is installed by allowing for the release of combustible moldings in the event of a fire on the opposite side of the doorway. It is yet a further object of the present invention to provide a molding, a mounting system using such a mounting device and molding, and a method for mounting a molding using such a mounting device.

These and other objects are achieved by the provision of a mounting device for releasably mounting a molding thereto, the device being capable of connection to a surface. The device comprises an elongate semi-rigid member having a first longitudinal edge and a second longitudinal edge opposite the first edge, and having a forward face and rear face, a protective lip extending forwardly from the member adjacent the first edge and forming a catch defining a longitudinal channel for receiving and holding the molding, and a resilient snap-catch extending forwardly from the member adjacent the second edge for releasably engaging the molding.

An architectural molding for mounting to such a mounting device is also provided. The molding comprises an elongate body having an inner edge, an outer edge opposite the inner edge, a decorative top surface between the inner and outer edges, and an underside between the inner and outer edges and opposite the top surface, the underside comprising a snap-catch engaging portion. A method of mounting an architectural molding to a surface using a mounting device is also provided. The method comprises the steps of (a) securing the mounting device to the surface, (b) restraining an inner edge by positioning said edge in a channel formed on the mounting device, and (c) securing the molding to a snap-catch of the mounting device.

DETAILED DESCRIPTION

The present invention relates to a mounting device for releasably mounting a molding. While a wide variety of uses of the mounting device are contemplated, including the releasable mounting of objects other than moldings to a variety of surfaces, such a mounting device is particularly useful in the mounting of architectural moldings to a hollow metal door frame of the type commonly used in commercial grade building construction. Accordingly, the following discussion describes the invention in relation to such use.

Figure 1:
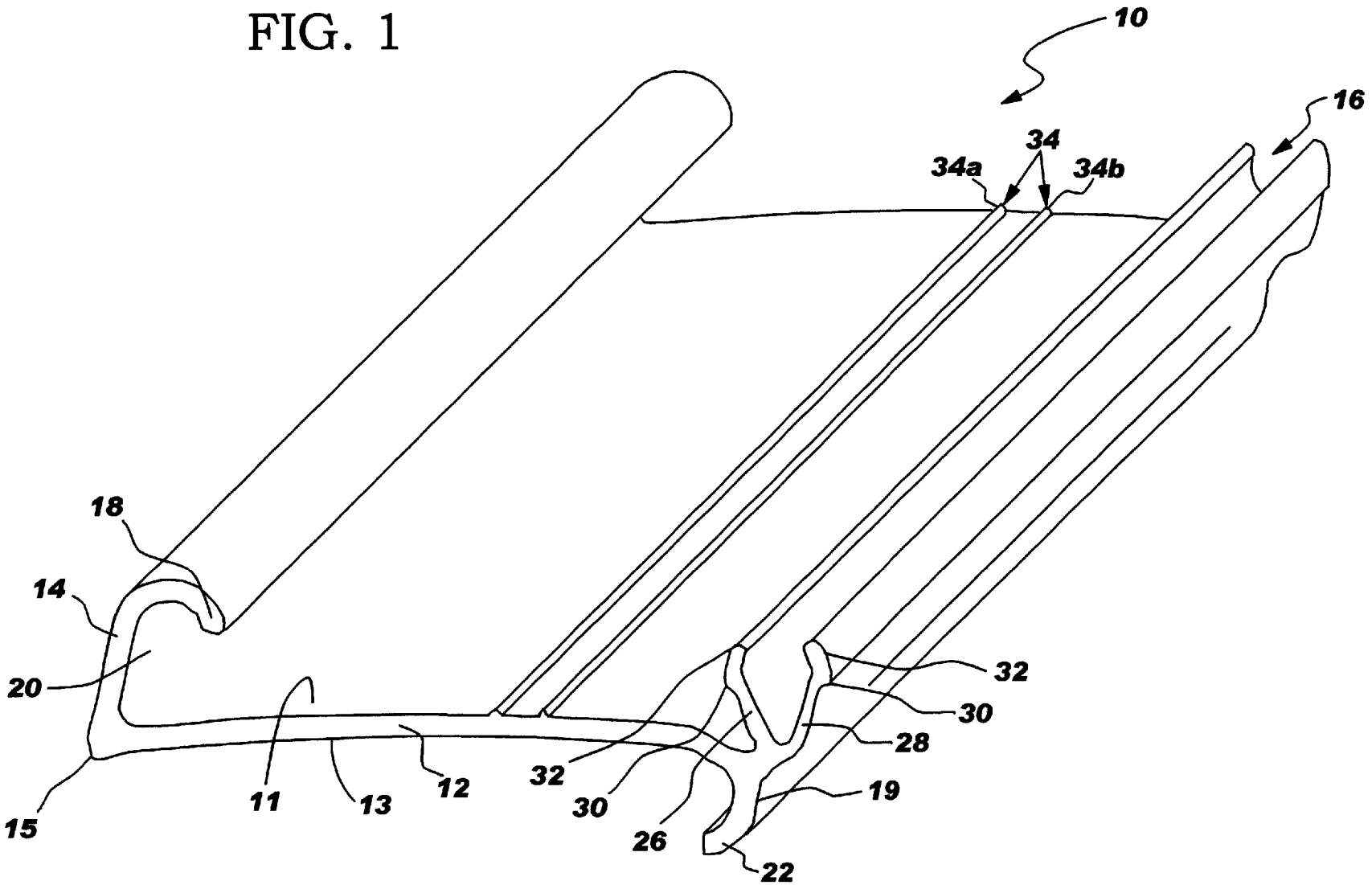
FIG. 1 is a perspective view of a mounting device in accordance with the present invention.

FIG. 1 shows a mounting device 10 in accordance with the present invention for mounting an architectural molding to a hollow metal door frame. The mounting device comprises an elongate semi-rigid member 12 having a forward face 11, a rear face 13, a protective lip 14 and a resilient snap-catch 16. The member 12 has a first longitudinal edge 15 and a second longitudinal edge 19 opposite the first longitudinal edge 15. In the preferred embodiment, the rear face 13 of the member 12 is concavely curved intermediate the first and second edges 15, 19 to impart added rigidity to the member when the rear face is mounted to a flat surface thereby flattening the curved portion of the rear face 13. Additionally, the mounting device 10 preferably comprises an alignment stop 22 extending rearwardly adjacent the second longitudinal edge 19 for positioning the mounting device relative to a surface as further described below.

The protective lip 14 extends forwardly adjacent the first longitudinal edge 15 of the member 12 and forms a catch 18 for protecting and retaining a molding. The catch 18 extends inwardly of the member 12 to define a longitudinally extending channel 20. While the protective lip 14, including the catch 18, may be presented in segments along the length of the mounting device 10, it is preferable that the protective lip 14 and catch 18 be longitudinally continuous as shown in FIG. 1.

Figure 2:
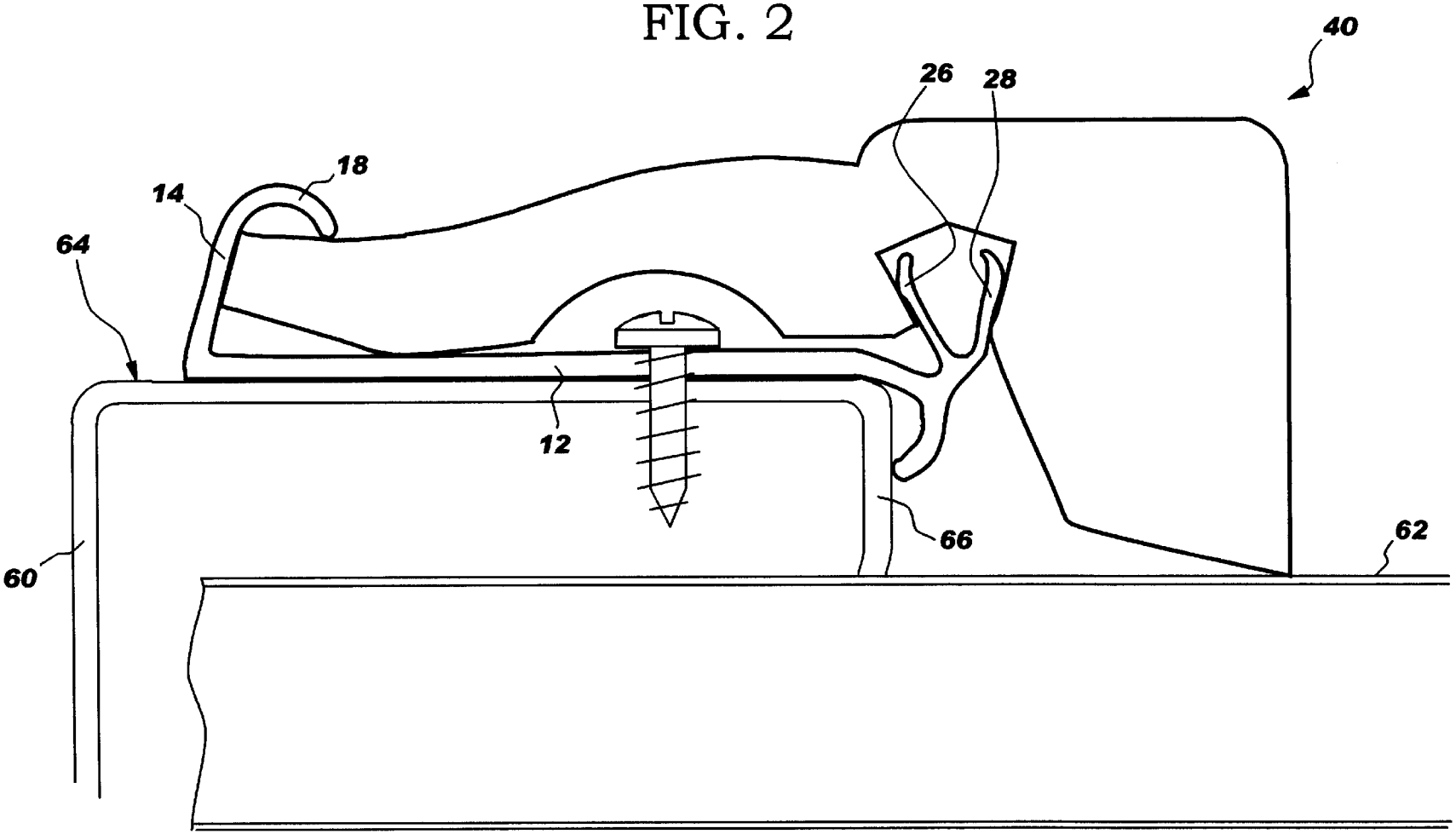
FIG. 2 is a cross-sectional view of the mounting device of FIG. 1 shown attached to a hollow metal door frame and having an architectural molding mounted thereto.
Figure 5:
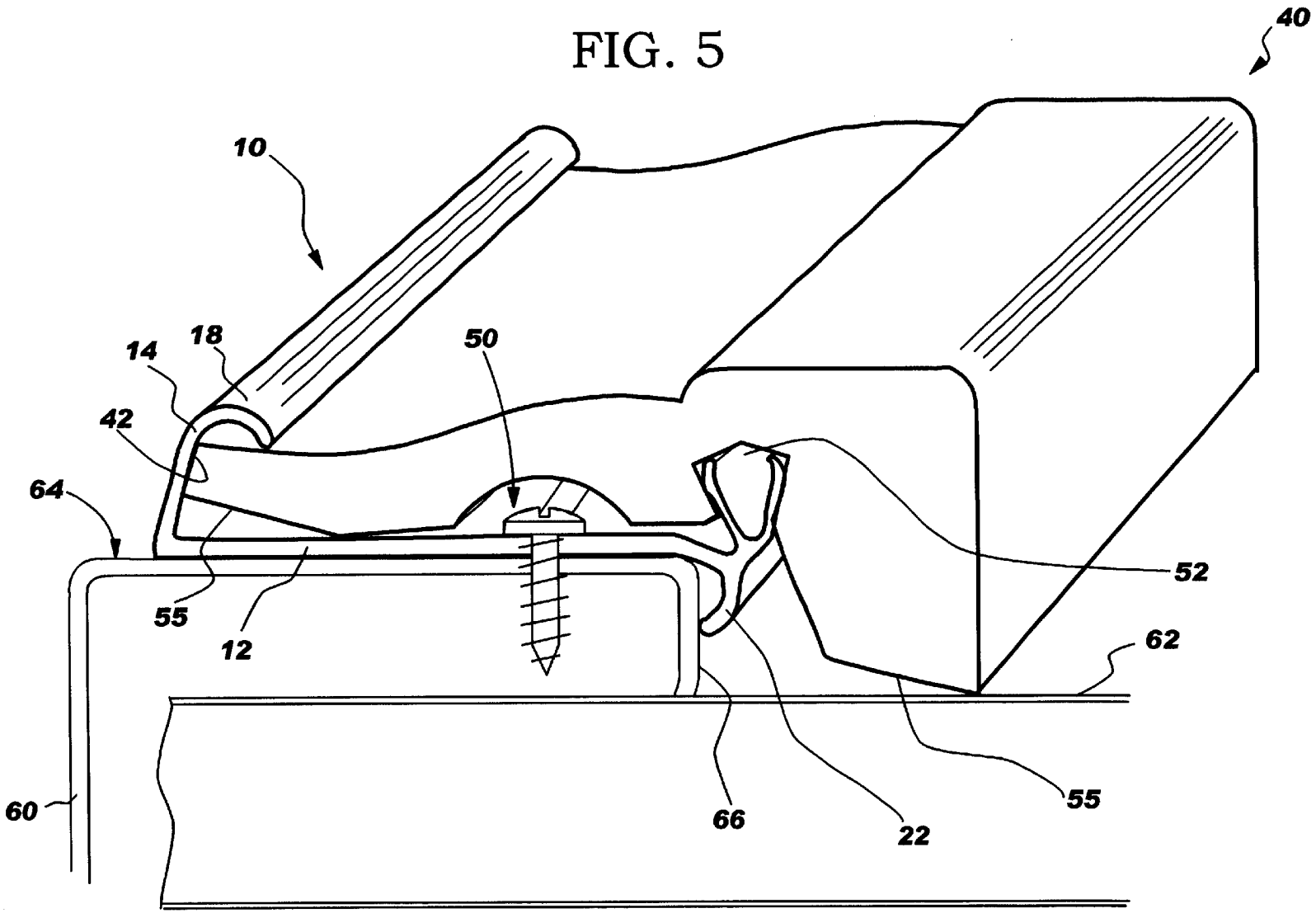
FIG. 5 is a perspective view of the architectural molding of FIG. 4 shown attached to the mounting device of FIG. 1. The mounting device is shown attached to a hollow metal door frame.

The resilient snap-catch 16 extends forwardly adjacent a second longitudinal edge 19 of the member 12, and may have any suitable configuration which allows for positive and releasable engagement of the molding to be mounted thereto. The engagement is releasable in that it allows for quick, tool-free, snap engagement/disengagement of the molding from the mounting device 10 without the need for removal of traditional molding fasteners, such as nails or screws. Preferably, the snap-catch 16 comprises a pair of resilient tabs 26, 28 as shown in FIGS. 1, 2 and 5. Each tab 26, 28 preferably has a shoulder 30 formed on its outer edge and terminates in an inwardly curled prong 32 which facilitates insertion into the molding as shown in FIG. 2 and which is further described below. While the snap-catch 16 may be presented in short segments along the length of the mounting device 10, it is preferable that the snap-catch 16 be longitudinally continuous as shown in FIG. 1.

Figure 3:
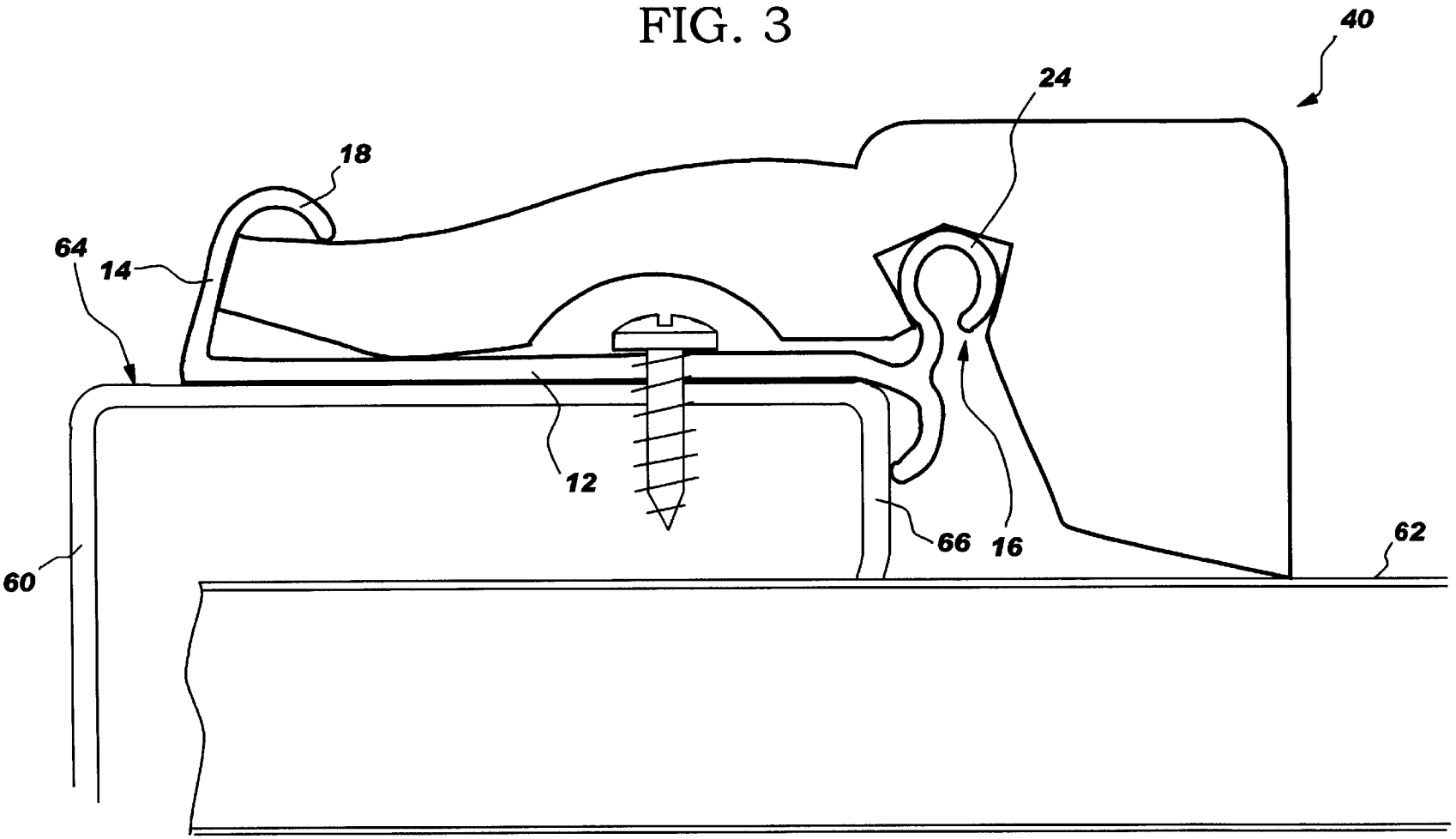
FIG. 3 is a cross-sectional view of another embodiment of a mounting device in accordance with the present invention having a snap-catch comprising a curled tab. The mounting device is shown attached to a hollow metal door frame and having an architectural molding mounted thereto.

An alternate snap-catch 16 comprising a curled tab 24 is illustrated in FIG. 3. In this embodiment, the curled tab 24 preferably forms a nearly closed loop to permit resilient 10 flexing of the snap-catch 16 and facilitate releasable engagement with a molding.

In the preferred embodiment, the member 12 further comprises a spaced pair of guidelines 34 extending longitudinally along the forward face 11 of the member 12. Preferably the guidelines 34 are in the form of ridges 34*a*, 34*b* integrally formed with the member 12, as shown in FIG. 1. These guidelines provide a point of reference for proper location of mounting screws.

The mounting device 10 should preferably have a uniform cross-section and be formed of an inexpensive, semi-rigid thermoplastic material. Furthermore, it is preferable that the mounting device 10 be formed of a material having a melting point sufficiently low to substantially soften when exposed to heat such as would be transmitted by the metal frame when in proximity to a fire. The configuration of the mounting device permits the mounting device to release the wooden molding mounted thereto upon melting, thereby removing ignitable materials adjacent the door and increasing the fire resistance of the doorway structure by preventing these materials from acting as fuel for the fire. Suitable materials include polyvinyl chloride.

An architectural molding suitable for mounting to a mounting device in accordance with the present invention is described below. It is understood that any object to be mounted using a mounting device in accordance with the present invention must be similarly configured to interfit with the mounting device.

Figure 4:
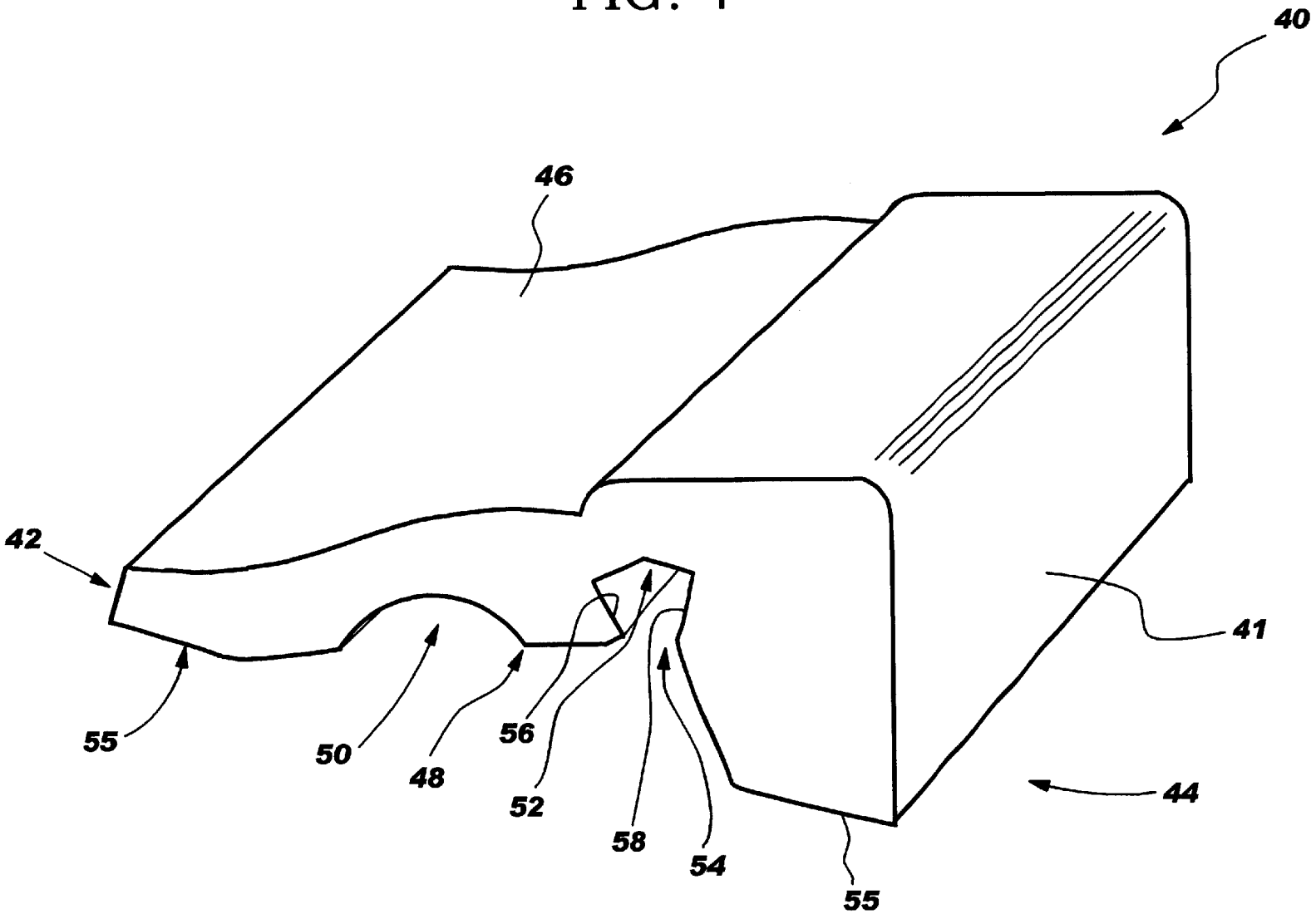
FIG. 4 is a perspective view of an architectural molding in accordance with the present invention.

Referring now to FIG. 4, an architectural molding 40 in accordance with the present invention is illustrated. The molding 40 comprises an elongate body 41 having an inner edge 42, an outer edge 44 opposite the inner edge 42, a decorative top surface 46 between the inner and outer edges, and an underside 48 between the inner and outer edges and opposite the decorative top surface 46. The underside 48 comprises a fastener receiving portion 50 and a snap-catch engaging portion 52. The fastener receiving portion 50 preferably extends longitudinally and is sufficiently recessed to accommodate and avoid interfering with the head of a fastener, such as a screw, used to secure the mounting device 10 to a surface. The snap-catch engaging portion 52 has reentrant latching surfaces 56, 58, forming a narrow entrance 54 as shown in FIGS. 2–5.

The decorative top surface 46 and the underside 48 may be contoured in any suitable fashion to provide both an aesthetically pleasing appearance and sufficient molding rigidity to provide adequate resistance to breakage of the molding 40 during mounting and demounting of the molding to the mounting device 10. The underside 48 is contoured to accommodate the protruding surface 64 and edge 66 of the hollow metal door frame 60, as shown in FIGS. 2 and 5. The configuration of the snap-catch engaging portion 52 of the molding 40 as shown in FIG. 4 is particularly preferable because the molding has a flat back portion 55 which rests against the table surface of the molding machine during fabrication of the molding and because the snap-catch engaging portion 52 is dovetail shaped. The configuration shown is also preferable in that latching surface 58 is substantially perpendicular to the flat back portion 55 of the molding which allows the cutting of this latching surface 58 and the fastener receiving portion 50 in the same operation on the molding machine during fabrication of the molding. The configuration of reentrant latching surface 56 is also preferable because its geometry permits cutting of this latching surface 56 in the same pass of the molding stock through the molding machine. It is preferable that the molding have a uniform cross-section, as shown in FIGS. 2, 4 and 5 and be formed of wood or a similar decorative material such as a plastic or composite material.

A mounting device 10 in accordance with the present invention can be used to mount an architectural molding to hollow metal door frame by a method comprising four basic steps. The method comprises the steps of securing the mounting device to the work surface, i.e., door frame, restraining an inner edge of the molding by positioning the edge in the channel formed on the mounting device, and causing lateral deflection of a latch portion of a snap-catch of the mounting device and permitting the latch portion to resile, i.e., snap back, to engage the molding. This method is described in more detail below.

The mounting device 10 is preferably cut to an appropriate length before being secured to the surface, e.g., a hollow metal door frame. A cross-section of a mounting device 10, with a molding 40 mounted thereto, is shown secured to a hollow metal door frame 60 in FIGS. 2, 3 and 5. The hollow metal door frame 60 is shown as it meets with a portion of a partition wall 62. The cross-section shown could be that of a header or a door jamb.

To secure the mounting device 10 to the outer surface 64 of the hollow metal door frame 60, the mounting device is preferably positioned on the outer surface 64. The alignment stop 22 is formed to be compatible with the particular structure of the door frame 60 to provide quick and easy alignment therewith. It is simply positioned such that the alignment stop 22 abuts the edge 66 of the door frame 60 and the protective lip 14 is adjacent the doorway opening in the partition wall 62. The alignment stop 22 serves to ensure proper alignment of the mounting device 10 with the hollow metal door frame 60. The mounting device 10 is then secured to the outer surface 64 of the hollow metal door frame 60 by driving a fastener, such as a screw, through the mounting device 10 between the guidelines 34 into the hollow metal door frame 60. The guidelines 34 of the member 12 are formed thereon to align the screw head with the fastener receiving portion 50 of the molding 40 to avoid interference therewith. The fastener is tightened until the fastener draws the curved rear face 13 of the mounting device 10 into at least partial contact with the outer surface 64 of the door frame 60. This ensures good contact between the protective lip 14 and the outer surface 64 of the door frame 60 and imparts rigidity to the mounting device 10 to reduce flexing thereof during removal of a molding 40 from the mounting device 10, as described below.

To mount the molding 40 to the mounting device 10, the inner edge 42 of the molding is first positioned in the channel 20. The molding is then urged into engagement with the mounting device 10 until the snap-catch 16 of the mounting device positively and resiliently engages the latching surfaces 56, 58 of the molding 40. In other words, the molding 40 is urged against the mounting device 10 to force the prongs 32 of the snap-catch 16 into the narrow entrance 54 of the snap-catch engaging portion 52, the curved surface of the prongs 32 serving to guide the tabs 26, 28 into the snap-catch engaging portion 52. The tabs 26, 28 resiliently flex outwardly against the reentrant latching surfaces 56, 58 of the molding, the shoulders 30 of the tabs 26, 28 enhancing the positive engagement of the snap-catch 16 with the molding 40. Accordingly, the tabs 26, 28 are caused to deflect laterally, e.g., inwardly, to enter the snap-catch engaging portion 52 and are then permitted to resile, i.e. "snap back" in an opposite direction, e.g. outwardly. The configuration of the reentrant latching surfaces 56, 58 and the snap-catch tabs 26, 28 provides the advantage of accommodation of variations in the relationship of the outer surface 64 of the door frame 60 to the surface of the partition wall 62 to ensure a good fit between the molding 40 and the partition wall 62 adjacent the molding's outer edge 44 by permitting the snap-catch 16 of the molding device 10 to ride in the snap-catch engaging portion 52 of the molding 40. The snap-catch 16 and the catch 18 of the mounting device's protective lip 14 cooperate to positively engage and retain the molding 40. The molding is thereby mounted without the driving of fasteners through the decorative top surface 46 of the molding 40 and without the time and effort necessary to attempt to conceal these fasteners as is customary to provide an overall aesthetically pleasing appearance. Here, the fasteners are completely hidden behind the mounted molding.

The mounting device 10 and molding 40 could be individually cut to nearly equal lengths. However, the demountable design permits both parts to be cut as an assembly, then separated for installation. Accordingly, it is preferable that the molding 40 is first mounted on the mounting device 10, as described above. The molding 40 and mounting device 10 assembly is then cut to ensure that the molding 40 and the mounting device 10 are of equal length. The cut molding 40 is then removed from the cut mounting device 10 to permit securing of the mounting device 10 to the door frame 60.

After securing mounting devices to the jambs and header of the door frame and mounting molding thereto, the moldings frequently require minor adjustments to ensure a proper fit at the joint of a molding, which is typically simple abutment in the case of an installation using rosettes or other corner accents, and typically a mitered joint in the case of abutting moldings. The uniform cross-section configuration of the molding and the mounting device provide the advantage of easy adjustment by simply sliding the molding 40 along the length of the mounting device 10.

The mounting device 10 is mounted to the door frame 60 with the protective lip 14 adjacent the inside edge of the doorway opening. The protective lip, extending over the inner edge 42 of the molding 40, protects the mounted molding against wear from traffic, e.g., persons, wheelchairs, carts, equipment, gurneys, passing through the doorway. This increases the longevity of the molding and prolongs the molding's aesthetic appearance.

When it becomes desirable to replace a molding due to excessive wear or for other aesthetic reasons, the molding 40 may be quickly and easily removed from the mounting device 10 without the need for removal of fasteners. The molding 40 is simply grasped adjacent its outer edge 44 opposite the protective lip 14 of the mounting device 10, prying the molding from the wall if necessary, and rotated away from the partition wall 62 such that the snap-catch 16 exits the snap-catch engaging portion 50 of the molding 40. The tabs 26, 28 flex inwardly to allow passage of the tabs 26, 28 through the narrow end 54 of the snap-catch engaging portion 52 of the molding 40. The molding 40 is then manipulated to remove the inner edge 42 of the molding 40 from the channel 20 defined by the member 12 and protective lip 14 of the mounting device 10. A replacement molding may then be mounted to the mounting device 10 as described above.

As referred to above, the mounting device may be formed of any suitable material, such as metal or plastic. However, forming the mounting device of a thermoplastic material having a relatively low melting point provides an additional advantage and is therefore preferred. An important consideration in building construction is fire resistance. The existence of ignitable materials, such as a wooden molding, on the non-fire side of a doorway opening decreases the fire resistance of a doorway because it provides fuel for passage of the fire from the fire side of the door to the non-fire side of the door. Forming the mounting device 10 of a material having a sufficiently low melting point to enable the mounting device to soften, in the event of a fire on an opposite side of a closed door, sufficiently to release the molding from the mounting device removes ignitable materials from the door frame and increases the fire resistance of the doorway structure by preventing the molding from acting as fuel for propagation of flames from the fire side to the non-fire side of the door. Accordingly, a polyvinyl chloride plastic material is preferred.

Having thus described particular embodiments of the invention, various alterations, modifications, and improvements will readily occur to those skilled in the art. Such alterations, modifications and improvements are intended to be part of this description though not expressly stated herein, and are intended to be within the spirit and scope of the invention. Accordingly, the foregoing description is by way of example only, and not limiting. The invention is limited only as defined in the following claims and equivalents thereto.

What is claimed is:

1. A mounting device for releasably mounting a molding thereto, the device being capable of connection to a surface, the device comprising:

an elongate semi-rigid member having a first longitudinal edge and a second longitudinal edge opposite the first edge, and having a forward face and rear face;

a protective lip extending forwardly from the member adjacent the first edge and forming a catch defining a longitudinal channel for receiving and holding the molding;

a resilient snap-catch extending forwardly from the member adjacent the second edge for releasably engaging the molding, the snap-catch comprising a latch portion configured to deflect in a lateral direction upon initial contact with the molding and to subsequently resile in a direction opposite said lateral direction to engage and retain the molding; and an alignment stop extending rearwardly from the member adjacent the second edge for positioning the mounting device relative to the surface.

2. The mounting device of claim 1, wherein the latch portion of the resilient snap-catch comprises a curled tab.

3. The mounting device of claim 2, wherein the curled tab of the snap-catch forms a nearly closed loop.

4. The mounting device of claim 1, wherein the latch portion of the resilient snap-catch comprises a pair of tabs capable of resiliently flexing inwardly toward one another.

5. The mounting device of claim 4, wherein each of the pair of tabs comprises a shoulder formed on an outer edge of the tab to engage a latching surface of the molding.

6. The mounting device of claim 5, wherein the member comprises a guideline on the forward face of the member for facilitating the positioning of a fastener to secure the member to the surface.

7. The mounting device of claim 6, wherein the rear face of the member is concavely curved intermediate the first and second edges to impart rigidity to the member when the curved rear face is mounted to a flat surface.

8. The mounting device of claim 7, wherein the protective lip is longitudinally continuous.

9. The mounting device of claim 8, wherein the snap-catch is longitudinally continuous.

10. The mounting device of claim 9, wherein the mounting device is formed of a thermoplastic material.

11. The mounting device of claim 10, wherein the thermoplastic material has a melting point sufficiently low to permit softening of the mounting device when mounted on a non-fire side of a hollow metal door frame.

12. The mounting device of claim 1, wherein the latch portion of the snap catch extends at an oblique angle to a latching surface of the molding and is thereby configured to deflect in a lateral direction upon initial contact with the molding.

13. A mounting thereto device for releasably mounting a molding having a top surface, the device being capable of connection to a surface, the device comprising:

an elongate semi-rigid member having a first longitudinal edge and a second longitudinal edge opposite the first edge, and having a forward face and rear face;

a protective lip extending forwardly from the member adjacent the first edge and forming a catch defining a longitudinal channel for receiving, holding and covering at least a portion of the top surface of the molding;

a resilient snap-catch extending forwardly from the member adjacent the second edge for releasably engaging the molding; and an alignment stop extending rearwardly from the member adjacent the second edge for positioning the mounting device relative to the surface.

* * * * *

UNITED STATES PATENT AND TRADEMARK OFFICE

CERTIFICATE OF CORRECTION

PATENT NO. : 6,381,915 B1
APPLICATION NO. : 09/234013
DATED : May 7, 2002
INVENTOR(S) : James Wood It is certified that error appears in the above-identified patent and that said Letters Patent is hereby corrected as shown below:

-- 13. Claim should read as following
A mounting device for releasably mounting thereto a molding having a top surface, the device being capable of connection to a surface, the device comprising:

an elongate semi-rigid member having a first longitudinal edge and a second longitudinal edge opposite the first edge, and having a forward face and rear face;

a protective lip extending forwardly from the member adjacent the first edge and forming a catch defining a longitudinal channel for receiving, holding and covering at least a portion of the top surface of the molding;

a resilient snap-catch extending forwardly from the member adjacent the second edge for releasably engaging the molding; and an alignment stop extending rearwardly from the member adjacent the second edge for positioning the mounting device relative to the surface. --

Signed and Sealed this

Twenty-ninth Day of August, 2006

JON W. DUDAS
*Director of the United States Patent and Trademark Office*